US009486034B2

(12) United States Patent
Baltierra

(10) Patent No.: US 9,486,034 B2
(45) Date of Patent: Nov. 8, 2016

(54) FOOTWEAR HAVING A SOLE FORMED WITH A CAVITY RECEIVING A HIGHLY VISCOUS GEL

(76) Inventor: Julie Baltierra, Costa Mesa, CA (US)

( * ) Notice: Subject to any disclaimer, the term of this patent is extended or adjusted under 35 U.S.C. 154(b) by 416 days.

(21) Appl. No.: 13/200,456

(22) Filed: Sep. 23, 2011

(65) Prior Publication Data

US 2013/0074365 A1 Mar. 28, 2013

(51) Int. Cl.

| | |
|---|---|
| ***A43B 7/14*** | (2006.01) |
| ***A43B 13/16*** | (2006.01) |
| ***A43B 13/18*** | (2006.01) |
| ***A43B 13/38*** | (2006.01) |
| ***A43B 13/40*** | (2006.01) |
| ***A43B 17/02*** | (2006.01) |

(52) U.S. Cl.

CPC ..... *A43B 7/148* (2013.01); *A43B 7/142* (2013.01); *A43B 7/1425* (2013.01); *A43B 7/1445* (2013.01); *A43B 13/16* (2013.01); *A43B 13/188* (2013.01); *A43B 13/189* (2013.01); *A43B 13/383* (2013.01); *A43B 13/40* (2013.01); *A43B 17/026* (2013.01)

(58) Field of Classification Search

CPC .... A43B 13/02; A43B 13/141; A43B 13/16; A43B 13/187; A43B 13/188; A43B 13/189; A43B 17/003; A43B 17/006; A43B 17/026

USPC ..... 36/28, 30 R, 31, 43, 44, 88

See application file for complete search history.

(56) References Cited

U.S. PATENT DOCUMENTS

| | | | | |
|---|---|---|---|---|
| 2,581,524 | A * | 1/1952 | Ford | A43B 13/12 12/146 B |
| 7,047,669 | B2 * | 5/2006 | Polcek | 36/25 R |
| 7,284,342 | B2 * | 10/2007 | Avent et al. | 36/44 |
| 8,333,023 | B2 * | 12/2012 | Losio | 36/44 |
| 8,490,297 | B2 * | 7/2013 | Guerra | 36/29 |
| 2005/0086838 | A1 * | 4/2005 | Khantzis | 36/30 R |
| 2008/0244926 | A1 * | 10/2008 | Yu et al. | 36/28 |
| 2010/0139121 | A1 * | 6/2010 | Geer et al. | 36/88 |

* cited by examiner

*Primary Examiner* — Khoa Huynh
*Assistant Examiner* — Sharon M Prange

(57) ABSTRACT

A shoe has an insole having a heel in a customary supportive hard rubber-like material about 3 inches thick. The same rubber-like material surrounds the entire sole with a change in thickness beginning at the arch, where it slopes down, leveling out at a thickness of about 1¼ inches. This change in thickness creates a frontal recess, leaving a bead of rubber at the outer edge. This cavity holds a thick cushion of about 1¾ inches of highly viscous gel material held in place by the rubber lip and adhered to the elastic material. This creates a cushion when the foot applies weight. The front of the sole and the back of the heel are equal in height, giving the entire surface equal height planes for balance. The two materials are one rubber like, one gel like and slope toward each other at the arch in identical angles.

10 Claims, 5 Drawing Sheets

FOOTWEAR HAVING A SOLE FORMED WITH A CAVITY RECEIVING A HIGHLY VISCOUS GEL

BACKGROUND OF THE INVENTION

1. Field of the Invention

The present invention relates to the field of footwear and more specifically to shoes having a uniquely configured sole with a large cavity filled with a gel material to provide added comfort.

2. Background Art

Cushion pad inserts made of highly viscous gel-type material are not new. These pads claim to add additional padding for the ball of the foot when it has thinned out. This thinning can be due to age, illness, or any one or more of many malformations of the foot. The pad provider claims to reduce pain and ease discomfort. The problem with an insert in some cases is that it reduces the space inside the shoe and in some cases can actually cause additional pressure against the ball of the foot, toes or problem areas due to this reduction of space. Most shoes are not designed to allow additional room for enough padding to make a difference, without causing the wearer to lose needed room for the foot. When a wearer is seeking additional padding, they are typically also dealing with conditions where the bones of the foot, from the arch to the toes, or the toes themselves, are deformed in some way. When adding padding and limiting the interior space of the front of the shoe, pressure on these distorted areas of the toes or bones which cannot lay straight or normal, can cause blisters from rubbing on the inside top of the shoe.

Other therapeutic shoes have used additional type inserts of cushioning material within the shoe or sole but the additional padding appears to be hidden somewhere deep within and the surface of the sole remains hard. The deep chamber of material in the present invention does not "bottom out" after many times of wearing and allows for the normal amount of room needed for the front of the foot. The deep cushion of this invention allows space while the deformed toes sink unrestricted upon stepping and is less likely to rub on the upper inside of the surface of the shoe.

Both those with foot problems, as well as those without, will benefit from this invention. The pure comfort of extreme padding in the front of the shoe without the possibility of bottoming out, creates a feeling of walking or running on pillows. For those that suffer from foot ailments such as calluses, hammer toe, bunions, bone spurs, thinning or destruction of the foot pad, this very thick padded area, allows enough room as the foot presses into the gel bearing the weight of the wearer, allowing support, but also providing enough room to alleviate pain.

SUMMARY OF THE INVENTION

A shoe of a preferred embodiment of the present invention consists of an insole having a heel in a customary supportive hard rubber-like material about 3 inches thick. The same rubber-like material surrounds the entire sole with a change in thickness beginning at the arch, where it slopes down, leveling out at a thickness of about 1¼ inches. This change in thickness creates a frontal recess or cavity, leaving a ring or bead of rubber at the outer edge. This cavity holds a thick cushion of about 1¾ inches of highly viscous gel material held in place by the rubber lip and adhered to the elastic material. This creates an unrestricted cushion when the foot applies weight during walking or running. The front of the sole and the back of the heel are equal in height, giving the entire surface equal height planes for balance. The two materials are of different nature, one rubber like, one gel like and slope toward each other at the arch in identical angles. The gel material is on top of the rubber material at the arch, thus creating a smooth transition from one material to the other and they are bonded together at this juncture.

The outer appearance of the shoe is typical, without any visual evidence of the interior. Only upon inspection or wearing of the shoe, does the interior become evident. One shoe sample in the form of a tennis shoe, comprises a canvas type upper material with eyelets and laces, commonly known as a tennis shoe, but the invention is not limited to this application. This novel insole design can be employed in any type shoe from bowling, golf, running, basketball, or any shoe where extreme padding is needed for comfort.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Referring to the accompanying drawings, namely FIGS. 1-6, it will be seen that an exemplary embodiment of the present invention is shown in a sports shoe commonly referred to as a sneaker. In the conventional sneaker, the entire foot support structure (insole) is typically made of rubber or a rubber-like material. In the present invention, the foot support structure has a compound configuration made of two different materials, namely rubber and gel.

In the heel region, the support structure remains rubber or rubber-like material throughout the entire thickness of the structure. However, in the sole region where the arch, ball of the foot, and metatarsal and phalangal bones and the toes normally reside, the rubber material thickness is reduced to less than half of the overall thickness of the structure to form a large recess. This recess receives a gel material. This gel is much softer and more compressible than is the rubber or rubber-like material. In a preferred embodiment of a sneaker-type sports shoe, the gel is a silicone gel or viscoelastic urethane polymer having a durometer of about 10 on the Shore-OOO scale to 50 on the Shore-A scale.

The recess that receives the gel, is formed from the rubber that constitutes the conventional sneaker heel. A typical insole for a sneaker may have a total thickness of approximately three inches. In the heel region, the entire three inch thickness is made up of the standard hard rubber material normally found in sneakers. However, in the sole region, the rubber forms only the bottom 40% to 45% of three inch thickness, the top 55% to 60% being formed of the gel.

In order to provide structural support for the gel, the rubber material forms a small bead partially surrounding the entire perimeter of the recess receiving the gel. The bead would typically be about ¼ inch in height above the full layer of rubber which provides a platform in the recess for receiving the gel layer residing in the recess.

Figure 1:
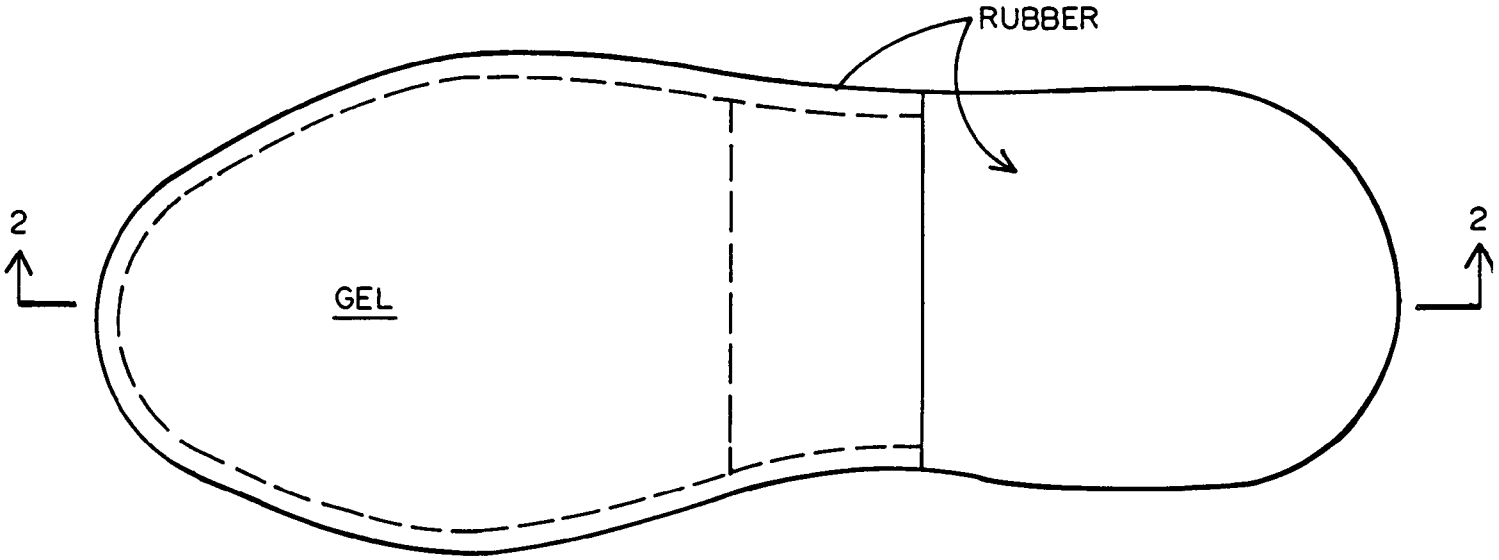
FIG. 1 is a top view of the foot support structure of a preferred embodiment of the invention.
Figure 2:
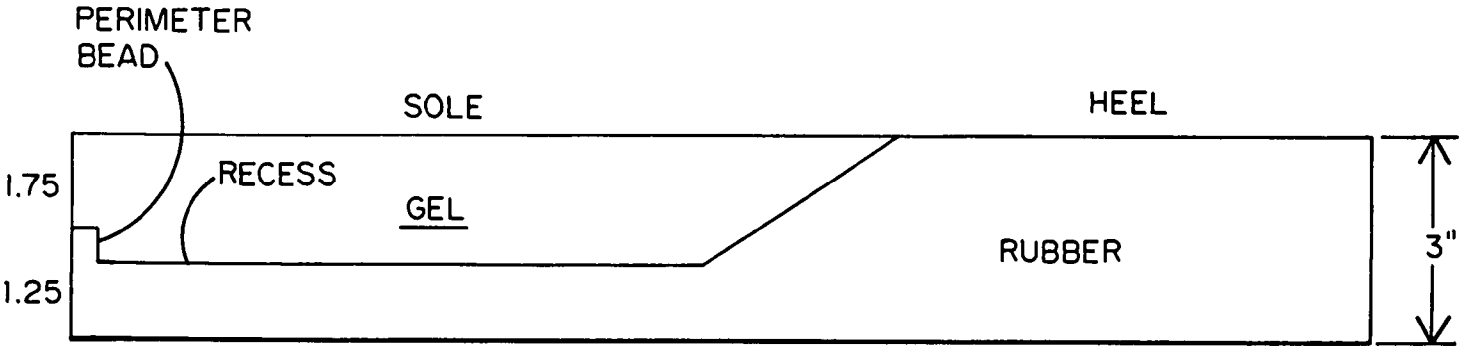
FIG. 2 is a cross-sectional view of the foot support structure taken along lines 2-2 of FIG. 1.
Figure 3:
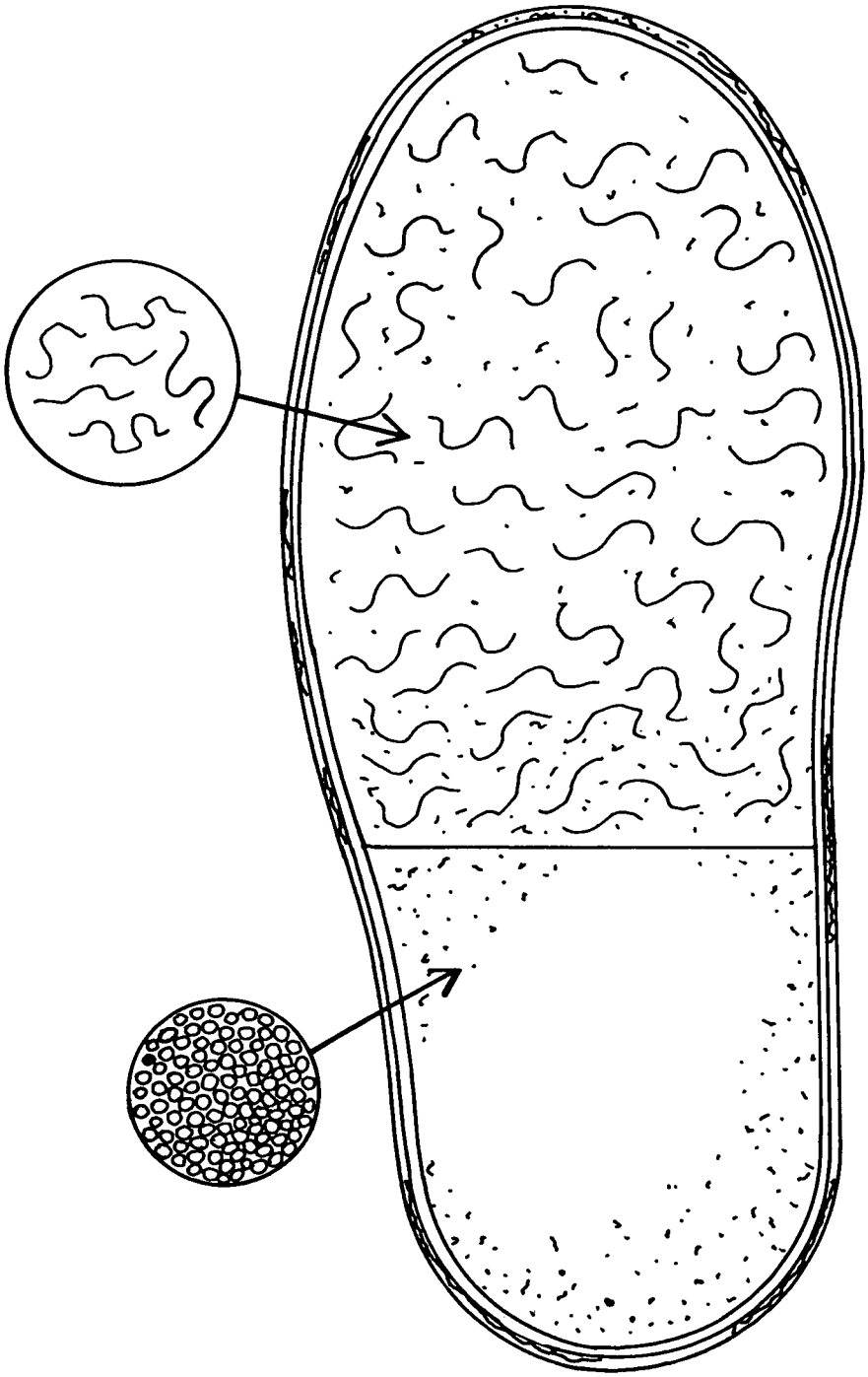
FIG. 3 is a top view similar to that of FIG. 1, but showing the respective materials used to form the heel and sole portions of the preferred embodiments.
Figure 4:
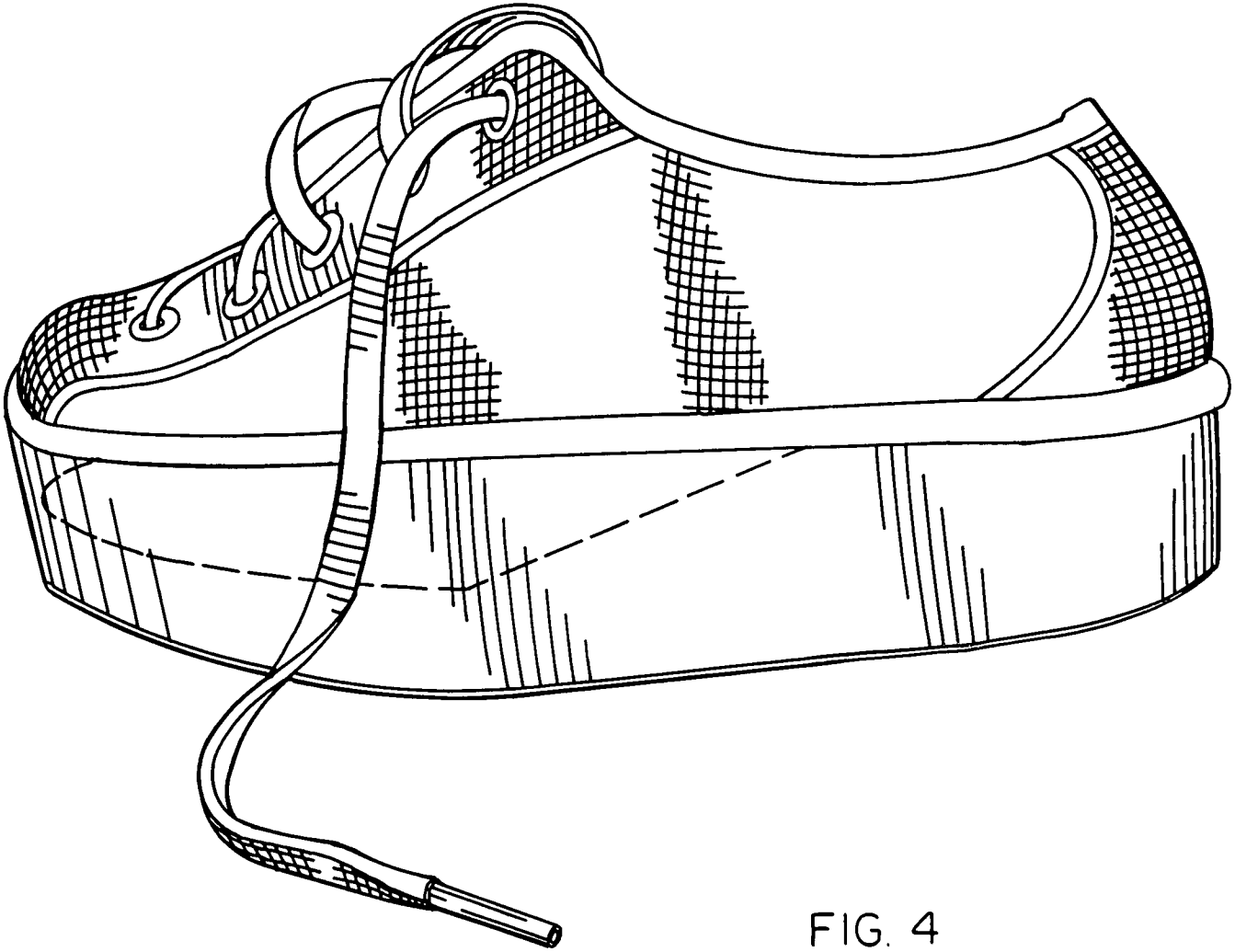
FIG. 4 is a left-side view of the entire shoe in which the foot support structure of FIG. 1 is employed.
Figure 5:
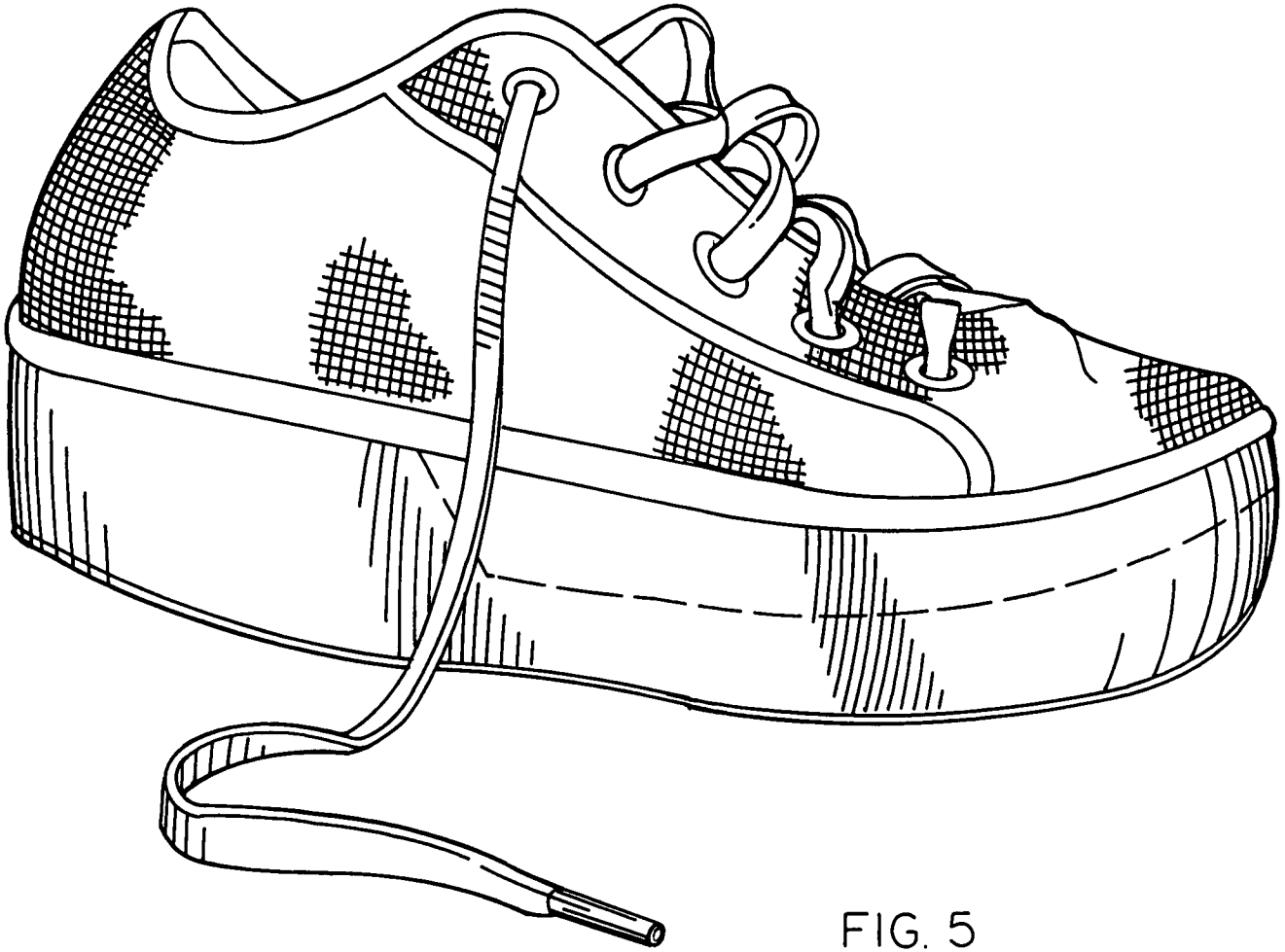
FIG. 5 is a right-side view of the show of FIG. 4.
Figure 6:
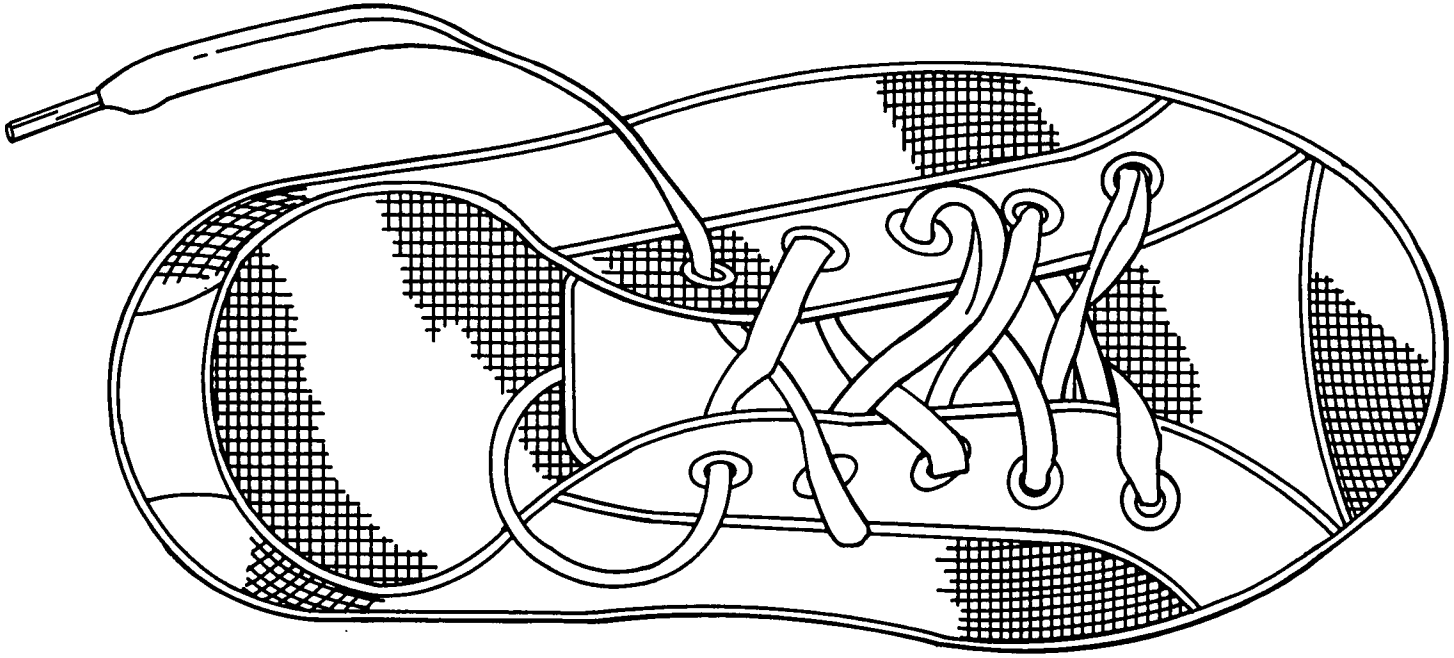
FIG. 6 is a top view of the shoe of FIG. 4.

The transition between the all-rubber heel and the gel/rubber sole, occurs at the arch region of the sneaker where the thickness of the gel is diminished linearly over about a 2 to 3 inch length along the axis of the sneaker as shown for example in FIGS. 1 and 2. The area with overlap between gel and rubber is preferably coated with a suitable adhesive to secure the gel to the rubber. In addition, the respective thicknesses are carefully controlled to maintain a relatively flat insole surface for promoting foot comfort and balance.

It will now be understood that the present invention relates to use of a relatively thick layer of gel material in the front or sole portion of an insole where it resides in a recess formed from a more conventional rubber or rubber-like material configured as the heel portion and the remainder of the insole. It is believed that the novelty of the invention herein resides primarily in the use of such a thick gel portion throughout the sole region of the foot support structure while nevertheless retaining a relatively planar insole surface that provides a user with a sense of balance and a high degree of comfort. However, the scope hereof is limited only by the appended claims.

I claim:

1. An insole of a shoe, consisting essentially of:

an insole that is about 3 inches thick along an entire length of said insole;

wherein said insole comprises two horizontal layers: a rubber or rubber-like material layer, a gel layer, and an adhesive;

wherein said insole comprises three portions: a heel portion, an arch portion, and a front portion;

wherein said rubber or rubber-like material layer runs an entire length of said heel portion, said arch portion, and said front portion;

wherein said heel portion consists entirely of said rubber or rubber-like material layer;

wherein a thickness of said rubber or rubber-like material layer of said arch portion gradually decreases from a distal end of said arch portion to a proximal end of said arch portion, such that said thickness of said rubber or rubber-like material layer decreases from said heel portion to said front portion of said insole, creating a recess from said distal end of said arch portion of said insole portion to said proximate end of said front portion;

wherein a thickness of said rubber or rubber-like material layer of said front portion is about 1.25 inches along said entire length of said front portion;

wherein said gel layer fills said recess, such that a thickness of said gel layer is about 1.75 inches along said entire length of said front portion and wherein said thickness of said gel layer gradually decreases from said proximal end of said arch portion to said distal end of said arch portion, such that said thickness of said gel layer decreases from said front portion of said insole to said heel portion of said insole; and wherein said adhesive secures said gel layer to a top side of said rubber or rubber-like material layer.

2. The insole of claim 1, wherein said recess is substantially ringed by a lip that is constructed of a rubber or rubber-like material.

3. The insole recited in claim 1 wherein said gel layer has a durometer of about 10 on the Shore-000 scale to 50 on the Shore-A scale.

4. The insole recited in claim 1, wherein within said arch portion the respective thicknesses of said gel layer and said rubber or rubber-like material layer change continuously along said length of said arch portion of said insole.

5. The insole recited in claim 1 wherein said rubber or rubber-like material layer has a durometer of greater than 50 on the Shore-A scale.

6. An insole of a shoe, comprising:

an insole that is about 3 inches thick along an entire length of said insole;

wherein said insole comprises two horizontal layers: a rubber or rubber-like material layer, a gel layer, and an adhesive;

wherein said insole comprises three portions: a heel portion, an arch portion, and a front portion;

wherein said rubber or rubber-like material layer runs an entire length of said heel portion, said arch portion, and said front portion;

wherein said heel portion consists entirely of said rubber or rubber-like material layer;

wherein a thickness of said rubber or rubber-like material layer of said arch portion gradually decreases from a distal end of said arch portion to a proximal end of said arch portion, such that said thickness of said rubber or rubber-like material layer decreases from said heel portion to said front portion of said insole, creating a recess from said distal end of said arch portion of said insole portion to said proximate end of said front portion;

wherein a thickness of said rubber or rubber-like material layer of said front portion is 40% to 45% of the total thickness of the insole along said entire length of said front portion;

wherein said gel layer fills said recess, such that a thickness of said gel layer is 55% to 60% of the total thickness of the insole along said entire length of said front portion and wherein the thickness of said gel layer gradually decreases from said proximal end of said arch portion to said distal end of said arch portion, such that said thickness of said gel layer decreases from said front portion of said insole to said heel portion of said insole; and wherein said adhesive secures said gel layer to a top side of said rubber or rubber-like material layer.

7. The insole of claim 6, wherein said recess is substantially ringed by a lip that is constructed a rubber or rubber-like material.

8. The insole recited in claim 6 wherein said gel layer has a durometer of about 10 on the Shore-000 scale to 50 on the Shore-A scale.

9. The insole recited in claim 6, wherein within said arch portion the respective thicknesses of said gel layer and said rubber or rubber-like material layer change continuously along said length of said arch portion of said insole.

10. The insole recited in claim 6, wherein said rubber or rubber-like material layer has a durometer of greater than 50 on the Shore-A scale.

* * * * *